United States Patent [19]

Prunier

[11] 4,291,508

[45] Sep. 29, 1981

[54] LENS SURFACING PAD

[75] Inventor: Louis Prunier, Charlton, Mass.

[73] Assignee: American Optical Corporation, Southbridge, Mass.

[21] Appl. No.: 99,227

[22] Filed: Nov. 30, 1979

[51] Int. Cl.[3] ..... B24D 10/02

[52] U.S. Cl. ..... 51/395; 51/406; 51/DIG. 34

[58] Field of Search ..... 51/402, 405, 406, 407, 51/401, 398, 395, 358, DIG. 34

[56] References Cited

U.S. PATENT DOCUMENTS

| | | | |
|---|---|---|---|
| 2,115,209 | 4/1938 | Mulholland | 51/358 |
| 2,282,650 | 5/1942 | Fenton | 51/396 |
| 2,653,428 | 9/1953 | Fuller | 51/395 |
| 3,144,737 | 8/1964 | Faas | 51/406 |
| 3,201,904 | 8/1965 | Evans | 51/358 |
| 3,517,466 | 6/1970 | Bouvier | 51/358 |
| 3,916,574 | 11/1975 | Prunier | 51/124 L |
| 3,959,935 | 6/1976 | Stoppacher | 51/406 |

*Primary Examiner*—Harold D. Whitehead
*Attorney, Agent, or Firm*—Alan H. Spencer

[57] ABSTRACT

A cutaway pad for surfacing lenses with grinding or polishing slurries which flow into and along the cuts for distribution across a lens surface worked thereover. The heretofore pad floppiness is relieved with a continuous film backing which is readily conformable to a surfacing tool face and affords large area contact to prevent pad slippage during lens surfacing.

9 Claims, 6 Drawing Figures

LENS SURFACING PAD

BACKGROUND OF THE INVENTION

1. Field of the Invention:

Lens surfacing equipment with particular reference to improvements in grinding and polishing pads.

2. Discussion of the Prior Art:

Lens grinding and polishing pads are commonly cut away to provide channels for distributing abrasive slurries over the surface of a lens to be worked. The cuts are usually radially oriented with many or all extending from near the center to the edge of the pad. This produces floppy pad segments rendering the pads difficult to handle and particularly difficult to attach to surfacing tools with their segments properly aligned and similarly difficult to remove for replacement.

With the usual adhesive backings of the floppy cutaways tending to accidentally stick to one another and to the hands or unwanted areas of a tool surface, a considerable waste of time and frustration can be experienced in initially applying the pad to a surfacing tool and/or replacing same, not to mention the costliness of machine downtime during pad installation or replacement. Pad slippage and wrinkling due to loss of tool contact in cutaway areas of prior art pads have also been detrimental to lens product yield and quality.

An object of the invention is to overcome the problems of difficult surfacing pad handling and more particularly provide for greater than usual ease of cutaway pad application to supporting tools and their replacement, all with an assurance of proper working alignment of pad segments and secureness of their attachment to the tools. Another object is to provide for simple one piece removal of spent pads.

Other objects and advantages of the invention will become apparent from the following description.

SUMMARY OF THE INVENTION

The foregoing object and others that may follow are accomplished with the provision of thin film backings for cutaway lens surfacing pads which permanently support and maintain the desired orientation of pad segments and cut channels. The film, in each case, is backed with a pressure sensitive adhesive for selectively attaching the pad to a surfacing tool.

With the adhesive-backed film forming an uninterrupted surface attachment to the tool, pad slippage is avoided during lens working and proper alignment of pad segments is maintained for optimum flow of abrasive slurries along the cutaways.

Details of the invention will become more readily apparent from the following description when taken in conjunction with the accompanying drawings.

IN THE DRAWINGS

DESCRIPTION OF THE PREFERRED EMBODIMENTS

Figure 1:
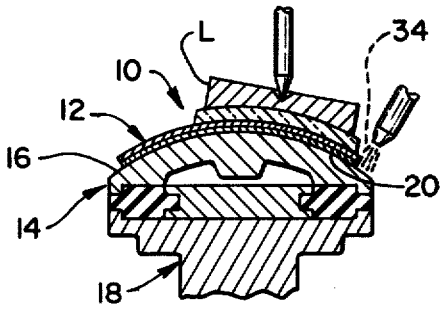
FIG. 1 is an illustration in cross-section of lens surfacing apparatus incorporating an embodiment of the present invention.

Referring to the drawings, apparatus 10 of FIG. 1 is exemplary of means used to surface (e.g., fine grind or polish) lenses with abrasive slurries. A blocked lens L is oscillated over a woven, felted or flocked pad 12 mounted upon a surfacing tool 14. The tool is provided with a surface 16 having a shape corresponding to that desired to be worked and pad 12 is adhesively attached to the tool surface 16. The tool surface which receives pads 12 may be formed of a wire mesh in which case pad 12 would be placed directly upon the wire mesh.

Tool 14 is supported by carrier 18 which may be rotated or held stationary if desired. Those interested in details of the operation of apparatus such as the above may refer to U.S. Pat. No. 3,916,574.

Figure 2:
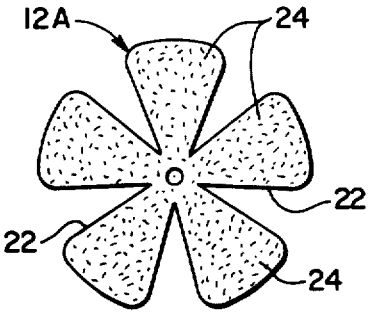
FIG. 2 (PRIOR ART)
FIG. 2 is a plan view of a prior art cutaway lens surfacing pad.

The felted, flocked or woven surfacing pad 12 normally has a pressure sensitive adhesive backing 20 for attachment to tool 14 or is placed directly upon the aforesaid wire mesh surface without adhesive backing 20. It is, in either case, typically cut away to provide radial channels for conducting abrasive slurries toward and away from the center of the pad, i.e. for distribution of the abrasive over the surface of a lens L being worked. Pad 12A (FIG. 2) having channels 22 is exemplary of a commonly used cutaway configuration.

Heretofore, however, the cutaways which form channels 22 have left the pad with floppy sections 24 (FIG. 2) which, with adhesive backings exposed, become difficult to handle. There is the tendency for the floppy sections to stick together, to the hands and/or to unwanted areas of a tool surface 16 intended to receive the pad and further become difficult to remove when replacement is necessary.

Figure 3:
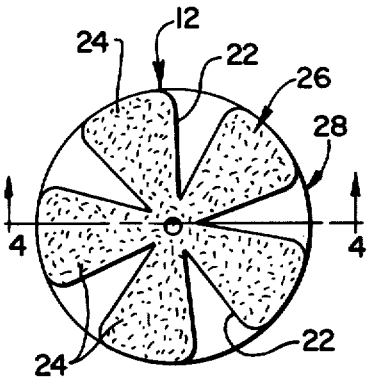
FIG. 3 is a similar plan view of a preferred embodiment of the invention.

In overcoming the frustration experienced in handling such pads and particularly with a view to avoiding pad slippage during use and the heretofore undue machine down-time resulting from tedious pad replacement, pad 12 (FIGS. 1 and 3) of the present invention is designed to permanently maintain a predetermine alignment of sections 24 and afford a greater than usual area of adhesive contact with the surface of a receiving tool. To this end the felted, flocked or fabric component 26 of pad 12 having the usual cutaway channels 22 is backed with a thin and flexible film 28, itself having a backing 30 of pressure sensitive adhesive and a strip-away protective cover 31. When intended for use over a wire mesh surface, the pressure sensitive adhesive may be omitted.

The cutaway pad component 26 is secured to film 28 with a suitable layer of adhesive 32 which holds the original precut geometrical shape and orientation of sections 24 during storage and use of the pad 12.

Suitable materials for film 28 are a rubber-resin adhesive on thin paper or on a polyester film. An example of the former is a double faced adhesive product of Minnesota Mining and Manufacturing Company, St. Paul, Minnesota, USA. This product is identified as 410 DSL. An example of the latter is a product of the same company having the commercial identification Y443. A useful single faced adhesive tape product also supplied by the above company is commercially identified as Surface Saver Tape.

Other films, tapes and adhesives known to be capable of performing the above functions may be used at the discretion of the artisan.

Figure 4:
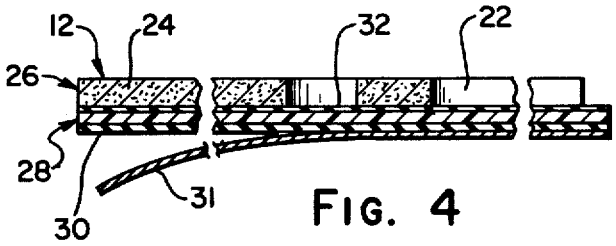
FIG. 4 is an enlarged cross-sectional view taken along line 4—4 through the surfacing pad of FIG. 3.
Figure 5:
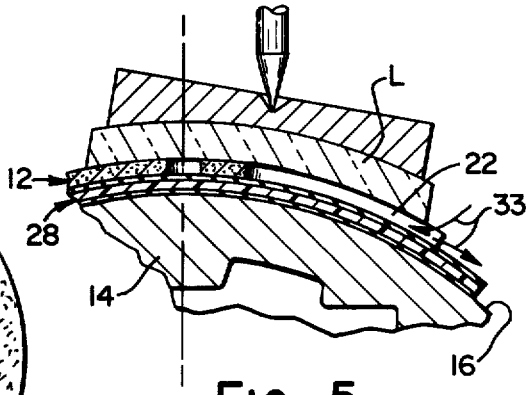
FIG. 5 is an enlarged fragmentary cross-sectional view of the apparatus of FIG. 1.

With pad 12 secured to tool 14 as illustrated in FIG. 5, film 28 and sections 24 of pad component 26 readily assume the particular configuration of the tool surface 16 leaving all channels 22 open adjacent their edges to permit an in-and-out flow of an abrasive slurry 32 as indicated by arrows 33. This enchances the working of the surface of lens L when pressed against pad 12 and oscillated thereover. Sections 24 of the pad component 26 are retained in their intended geometrical positions on tool 14 so that channels 22 do not become closed or excessively open by prior pad shifting, i.e. the full surface contact of film 28 over tool surface 16 prevents pad slippage and wrinkling. Pads 12 (FIGS. 3-5) applied to tool surfaces 16 of strong dioptric curvature may effect some tucking of film 28 in channels 22, all of which will take place below the effective abrading surface of sections 24 and only to an extent of occupying a small portion of the width of any one channel 22 so that the flow of abrasive slurries in channels 22 is, for all practical purposes, unaffected by the degree of curvature of tool surfaces 16 to which the present surfacing pads may be attached.

The foregoing illustrates the present objectives of affording greater than usual ease of cutaway pad application to tools and optimum secureness of their attachment. Additionally, the invention permits greater than usual relief (cutaway) of surfacing pads for improved lens surface abrading action. All pad sections such as 24, in all cases, are held in desired positions prior to and during use by film backings 28. The section 24 may be of various shapes and sizes and completely segmented, if desired. For example, sections 24 may be square or otherwise rectilinear and arranged in checker-board fashion on film 28.

Figure 6:
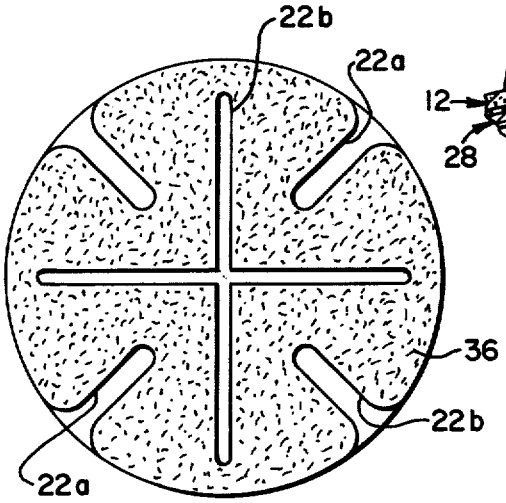
FIG. 6 is a plan view of a modification of the invention.

FIG. 6 illustrates another modification of a cutaway surfacing pad having film backing 28*a*, channels 22*a* extending inwardly from the edge of the pad and channels 22*b* extending outwardly from the center of the pad.

Use of the term "film" hereinabove is intended to include such thin and flexible sheet materials as paper and cloth as well as plastic materials. Also, the term "lens" is intended to include the ophthalmic product in any of its various stages of manufacturing, e.g. cast, molded, pressed and/or machined whether formed of glass, a resin or another form of plastic material.

It will become readily apparent to those skilled in the art that there may be modifications and other adaptations of the precise form of the invention shown and described. Accordingly, the foregoing illustrations are not to be interpreted as restrictive of the invention beyond that is necessitated by the following claims.

I claim:

1. A lens surfacing pad comprising:

a unitary cutaway main surfacing pad component having multiple interconnected pad sections with channelling therebetween for the distribution of abrasive slurries over the component during use of said pad; and a permanent thin and flexible supporting film to which said component is affixed for rendering said pad freely conformable to a lens surfacing tool of a surfacing machine without appreciable disruption of relative orientation of said pad sections, said film being continuous across said channels and securable to said surfacing tool.

2. A lens surfacing pad according to claim 1 including a backing on said film for securing said pad to said lens surfacing tool.

3. A lens surfacing pad according to claim 2 wherein said backing comprises an adhesive.

4. A lens surfacing pad according to claim 3 wherein said adhesive is pressure sensitive.

5. A lens surfacing pad according to claim 1 wherein said unitary pad component is fixed to said film with an adhesive.

6. A lens surfacing pad according to claim 1 wherein said unitary pad component is formed of felt.

7. A lens surfacing pad according to claim 1 wherein said unitary pad component is formed of a fabric.

8. A lens surfacing pad according to claim 1 wherein said unitary pad component is flocked.

9. A lens surfacing pad according to claim 1 wherein at least some of said channels extend to the very edge said pad component.

* * * * *